United States Patent [19]

Haber

[11] 3,946,173

[45] Mar. 23, 1976

[54] ACCELERATION/DECELERATION ACTUATING MECHANISM FOR WRIST INSTRUMENTS

[76] Inventor: Terry M. Haber, Santa Ana, Calif.

[22] Filed: Jan. 6, 1975

[21] Appl. No.: 538,743

[52] U.S. Cl. ..... 200/52 R; 58/50 R; 200/61.45 M; 200/61.52; 240/6.43; 335/205

[51] Int. Cl.[2] H01H 35/00; G04B 19/30; G04C 23/10

[58] Field of Search .. 200/61.45 R, 61.45 M, 61.46, 200/61.52, 61.53, DIG. 29, 52 R, 61.83; 58/23 R, 50 R, 85.5, 1 M; 335/205; 224/28 R, 28 C, 28 W; 235/92 T

[56] References Cited

UNITED STATES PATENTS

| | | | |
|---|---|---|---|
| 3,114,236 | 12/1963 | Ross | 240/6.43 X |
| 3,911,666 | 10/1975 | Haber | 58/50 R |

FOREIGN PATENTS OR APPLICATIONS

| | | | |
|---|---|---|---|
| 341,770 | 11/1959 | Switzerland | 240/6.43 |

*Primary Examiner*—James R. Scott
*Attorney, Agent, or Firm*—Ralph B. Pastoriza

[57] ABSTRACT

Terminals within a digital wristwatch which normally require closure by pressing a button on the side of the watch in order to render visible the display are arranged to be automatically closed by a magnetic inertial device within the watch casing. The magnetic inertial device includes a guide tube and a conducting ball held at one end of the tube by a permanent magnet. The terminals to be closed and thus render visible the display on the watch are positioned in the other end of the guide tube so that by flicking the wrist, the ball is shaken loose from the magnet and will make momentary contact with the terminals, thereby rendering the display visible. A reading can thus be taken without requiring use of the other hand to operate the normal manual press-button switch on the side of the watch.

2 Claims, 5 Drawing Figures

ACCELERATION/DECELERATION ACTUATING MECHANISM FOR WRIST INSTRUMENTS

This invention relates to wrist instruments such as wristwatches and the like and more particularly to an improved actuating means for rendering the instrument display visible.

BACKGROUND OF THE INVENTION

Electronic quartz watches have become very popular in recent times primarily because of their ability to provide a digital read-out coupled with accuracy beyond that heretofore possible with conventional type watches. Essentially, a quartz crystal is used as an oscillator and the output frequency which is extremely stable is divided down into suitable clock pulses for actuating a digital display on the face of the watch.

The display can be provided by light emitting diodes (LED) or liquid crystal displays (LCD).

With either of the foregoing types of displays, no moving parts are required but in each event, an actuating means is required to render the display visible. In the case of the light emitting diode display, the diodes normally remain deenergized since energization thereof is the greatest source of power drain and if they remain illuminated, the power cells would have to be replaced too frequently. On the other hand, the liquid crystal displays are visible at all times but they do not exhibit a great deal of contrast and a light is typically incorporated to increase the contrast of the display. Again, the light does not remain on at all times since this would be too great a power drain.

Thus, with both of the foregoing types of displays, it is necessary and desirable to provide a switch which will close the necessary terminals to effect the desired actuation or illumination as the case may be. The conventional approach accordingly has been to incorporate a manual switch on the watch housing which is pressed to activate or illuminate the display. Unfortunately, the use of a manual switch, which must be actuated by the hand other than the one on which the watch is positioned is often inconvenient and many times impractical or impossible to operate. For example, when driving a car, carrying packages, and so forth it is very inconvenient to attempt to reach over with one hand to actuate the wristwatch switch carried on the wrist of the other hand.

In my copending patent application Ser. No. 516,688 filed Oct. 21, 1974 now U.S. Pat. No. 3,911,666 and entitled ACTUATING MECHANISMS FOR WRIST INSTRUMENTS, I have disclosed and claimed a switch arrangement which may be incorporated in watches of the type which require an actuating means to render the display visible and wherein such switch is operable by a flick of the wearer's wrist so that he need not use his other hand. More particularly, in my referred-to copending application, an electrical contact between appropriate terminals within the watch casing is effected by a hammer-like slug which engages against a springtype contact when the wrist is accelerated and/or decelerated deliberately a sufficient amount to cause a momentary contact between the spring contact and one terminal of the power source in the casing. This same copending application also discloses a pressure type switch which can be actuated by only one hand by pressing a portion of the watch band against a surface.

BRIEF DESCRIPTION OF THE PRESENT INVENTION

Bearing the foregoing in mind, the present invention contemplates a different type of switch arrangement for use in watches as described above which is somewhat more reliable in certain respects in assuring that a momentary contact can be effected in response to a simple and deliberate flicking of the wrist on which the watch is worn. Further, in one embodiment of the present invention, the improved magnetic inertial switch is designed to maintain terminals closed for as long as desired rather than to simply effect a momentary closure of the terminals to actuate the electrical means rendering the display visible.

Briefly, the invention contemplates in combination with a wrist instrument requiring closure of electrical terminals within the instrument to render visible the instrument reading, an actuating means for closing the terminals including: an inertial mass of conducting material within the instrument; magnet means holding the mass in a first position critically spaced from the terminal; and a guide structure within the instrument for guiding the mass towards and into physical contact with the terminals to close the same when the mass is shaken loose from the magnet by a deliberate rapid acceleration and/or deceleration movement of the wrist.

A second magnet may be provided adjacent the point that the mass closes the terminals to hold the mass in engagement with the terminals and thus maintain the circuit until the mass is shaken loose by a second or subsequent flicking of the wrist.

BRIEF DESCRIPTION OF THE DRAWINGS

A better understanding of this invention will be had by now referring to the accompanying drawings in which.

DETAILED DESCRIPTION OF THE INVENTION

Figure 1:
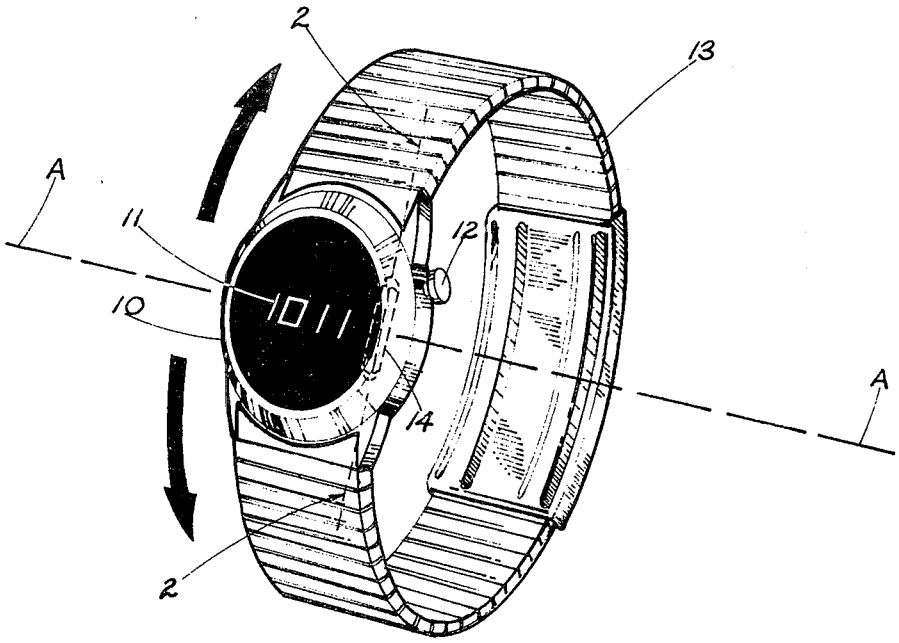
FIG. 1 is a perspective view of a typical quartz watch exemplary of the type of wrist instrument with which the present invention is utilized and wherein the watch shown incorporates the improved actuating mechanism of the present invention.

Referring first to FIG. 1, there is shown an electronic quartz watch including a casing 10 and a display 11. As discussed heretofore, the display 11 may be effected either by light emitting diodes or by illuminated liquid crystal displays. In either event, the actuation or illumination of the display is effected by a small push-button knob 12 disposed on the side of the casing 10 as shown. With this conventional arrangement, there is minimized the drain on the power cell within the watch casing since most power is drawn whenever the display is actuated. However, it will also be appreciated that with the conventional arrangement described, when the watch is worn on a person's wrist, it is necessary for him to use his other hand to actuate the button 12 so that both hands must be relatively free in order to tell the time.

The watch shown in FIG. 1 is normally secured to a person's wrist as by a suitable watchband 13. When so worn, the direction of the wrist is generally in the direction of the axis A—A shown in FIG. 1.

In accord with the present invention, there is provided an actuating means incorporated in the instrument casing for actuating the electrical means for rendering the display visible which electrical means would normally be actuated by operation of the push-button 12. This actuating means is indicated by the dotted lines generally at 14 in FIG. 1 and is elongated in construction, the axis of elongation being generally at right angles to the direction of the wearer's wrist. The reason for this orientation will become clearer as the description proceeds.

Figure 2:
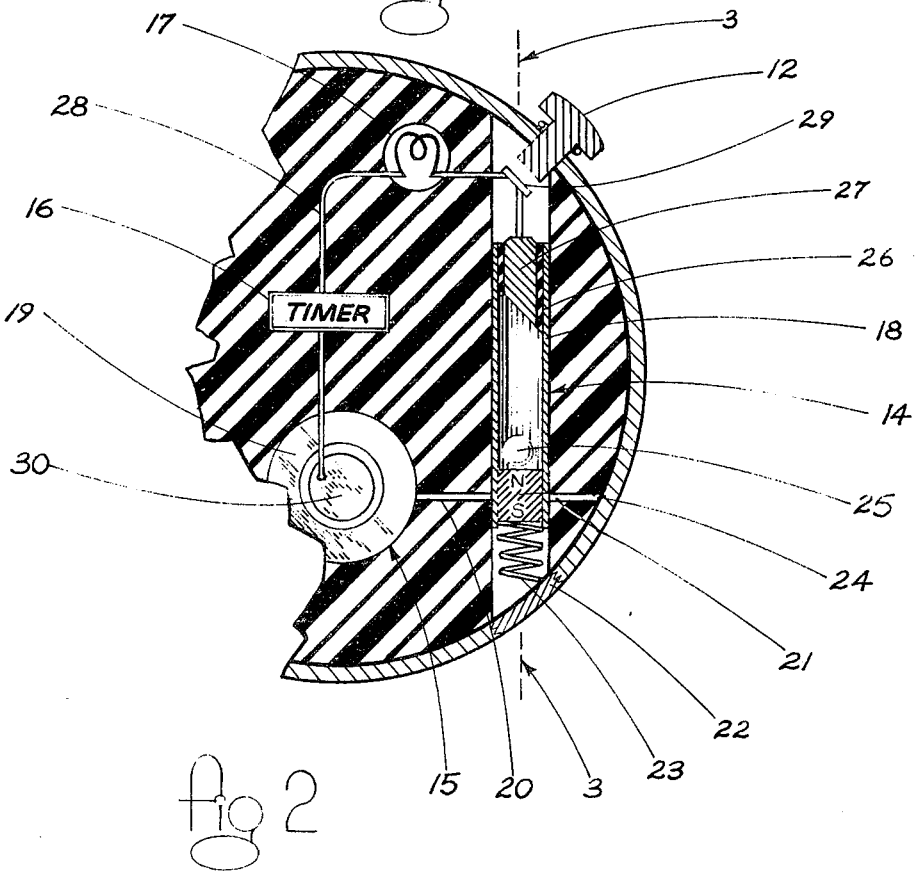
FIG. 2 is an enlarged fragmentary cross-section taken in the direction of the arrows 2—2 of FIG. 1.

Referring now to the enlarged fragmentary cross section of FIG. 2, there is partially shown inside the casing 10 of the watch a power cell or source 15 normally in the form of a battery in which the outer casing of the battery constitutes one terminal and the inner casing a second terminal. Also shown within the casing of the watch schematically is the electronic timer circuit 16 and an electrical means 17 for either actuating light emitting diodes or illuminating liquid crystals as the case may be in order to render the display visible.

Referring to details of the actuating means 14, this switch includes an elongated tube 18 of electrically conductive material secured in the casing 10 with its longitudinal axis spaced from and generally tranverse to the axis A—A of the forearm when the instrument is worn all as described in FIG. 1. One terminal of the power source 15 such as the outer casing of the battery indicated at 19 is connected to the conductive tube 18 as indicated at 20. This same terminal of the power cell is also connected to the casing 10 of the watch as indicated at 21. The conducting leads 20 and 21 are purely schematic in FIG. 2 to illustrate the electrical connection of the cell to the watch casing. Actually, the cell terminal need not be connected to the watch casing in which event a direct electrical connection such as shown at 20 would be made to the elongated electrically conducting tube 18. When the terminal of the power cell is connected to the watch casing, the elongated tube 18 may be connected to the watch casing as by the electrical lead 21, or by any other suitable contact such as through a conducting casing plug 22 covering the opening through which the tube 18 is inserted into the casing and a compression conducting spring 23 making contact with one end of the tube 18 and the conducting plug 22.

The one end of the elongated tube 18 connected to the casing or the one terminal 19 of the power cell includes a magnet 24. An inertial mass in the form of a conducting ball 25 within the tube 18 is normally held by the magnet 24 in this one end portion of the tube.

The opposite end portion of the tube includes an insulative sleeve 26 within which there is supported a conducting body 27. The body 27 is thus electrically insulated from the elongated tube 18 by the insulative sleeve 26.

A conducting lead 28 includes a contact 29 arranged to be engaged by the push button 12 on the side of the watch casing. It will be clear that when this contact 29 is engaged by the push button 12, it is electrically connected to the casing thereby completing a circuit from the one terminal 19 of a power cell 15 through the casing, the push button 12, contact 29 and lead 28 through the electrical means 17 and timer circuit 16 to a second contact 30 of the power cell 15. Actuation of the electrical means 17 as described will thus activate the light emitting diodes or illuminate the liquid crystals depending upon the type of watch involved. Normally, a momentary contact only is necessary, the timer 16 including a delay control which will maintain the electrical means 17 energized for a given length of time such as one or two seconds.

It will be noted that in accord with the present invention, the conductor 28 and contact 29 also connect directly to the conducting body 27 in the elongated conducting tube 18. Accordingly, it will be clear that if the conducting ball 25 is shaken loose from the magnet 24, and momentarily engages the conducting body 27 it will effect a direct electrical connection between the body 27 and the conducting tube 18 the latter in turn being connected to the casing so that a momentary contact will be effected the same as though the push button 12 were caused to engage the contact 28.

Figure 3:
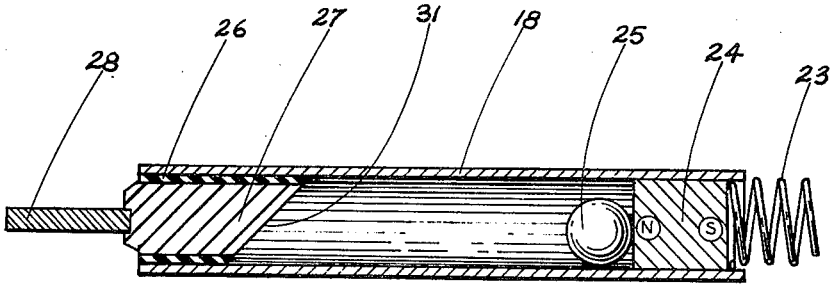
FIG. 3 is another fragmentary cross section taken in the direction of the arrows 3—3 of FIG. 2.

In the cross section of the actuating means as shown in FIG. 3, it will be noted that the conducting body 27 has a flat surface 31 facing at an angle to the one end of the tube 18 supporting the magnet 24. By this arrangement, the lower interior wall of the tube 18 defines with the angulated face 31 of the conducting body 27 a V-shaped entrance into which the ball 25 can seat to effect the electrical connection between the body 27 and tube 18.

Figure 4:
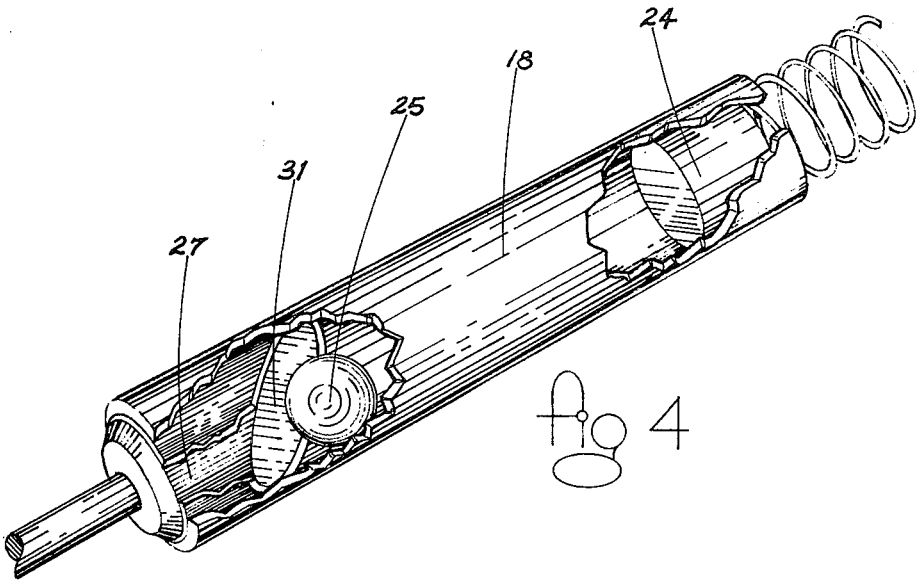
FIG. 4 is a perspective view of the device in FIG. 3 but illustrating a second position of one of the components; and, FIG. 5 is a view similar to FIGS. 3 and 4 but illustrating a second embodiment of the actuating mechanism.

FIG. 4 shows this seated position of the ball 25 wherein the electrical contact is made between the body 27 and wall of tube 18.

In certain types of watch constructions, a delay circuit is not included in the timer arrangement so that in order to render visible the display, it is necessary to maintain the electrical means 17 actuated as by holding the push button 12 in contact with the contact 29 for the length of time desired to view the display releasing of the button 12 then de-actuating the electrical means 17.

Figure 5:
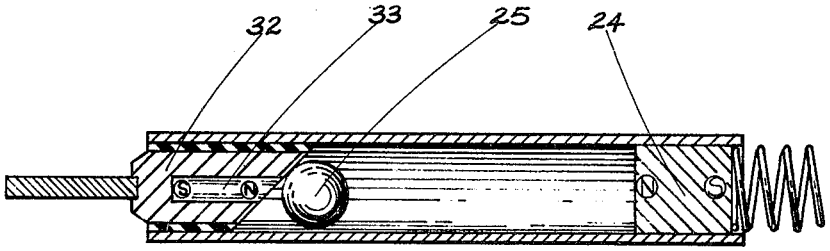

If the foregoing type of watch is used, the actuating means of the present invention would take the form illustrated in FIG. 5 which is similar to that already described with the exception that a modified conducting body 32 is provided with a cavity receiving a magnet 33. The magnet 33 would normally be weaker than the magnet 24 but would be sufficient to hold the ball 25 in its electrical-making contact position as shown until a second deliberate flick of the wrist is effected to shake the ball loose.

OPERATION

The operation of the inertial type switch actuating means will be evident from the foregoing description. With the elongated conducting tube 18 positioned in the watch casing as described in conjunction with FIGS. 1 and 2, and with the ball 25 normally held in one end of the tube by the magnet 24, the watch will function in the usual manner. Thus, a user can depress the actuating button 12 to illuminate the display anytime he desires.

In those instances, however, where the wearer's other hand is not free or for some other reason it is inconvenient for the user to depress the button 12 with his other hand, he can effect a deliberate acceleration and/or deceleration of his wrist by flicking the same generally in the direction of the elongated tube 18; that is, in a direction generally at right angles to the direction of his wrist through the band 13 as described in FIG. 1. This deliberate action will result in the ball 25 being shaken loose from the magnet 24 and moving to the other end of the tube to effect at least a momentary contact between the conducting body 27 and the casing 18 thereby completing a circuit through the electrical means 17 all as described in FIG. 2.

The momentary completion of the circuit will actuate the normal delay means in the timing circuit so that the display will be visible for a time period, depending upon the time delay in the timing circuit. The display will then automatically extinguish, the ball in the tube returning to the magnet 24 where it is held.

In the event the watch involved does not incorporate a delay means to hold the display, the modified structure illustrated in FIG. 5 may be used wherein there is provided the second magnet 33 so that after the user flicks his wrist, the ball will be held on the second magnet until a deliberate further flicking shakes the ball loose from the second magnet and returns it to the first magnet.

From the foregoing description, it will thus be evident that there has been provided an improved acceleration/deceleration actuating mechanism for wristwatches which can be easily installed even in existing watches or, introduced at the time of manufacture.

What is claimed is:

1. In combination:

a. an instrument adapted to be worn on the wrist and including a casing incorporating a power source, a display and electrical means for rendering the display visible when actuated; and b. an actuating means incorporated in said casing for actuating said electrical means in response to a deliberate, rapid acceleration and/or deceleration of the wrist, said actuating means including:

1. an elongated tube of electrically conductive material secured in the casing with its longitudinal axis generally at a right angle to the direction of the wrist when the instrument is worn, said casing being electrically connected to one terminal of said power source;

2. a resilient conducting means bearing against one end of said tube, the other end of said resilient conducting means engaging said casing to provide an electrical connection between said elongated tube and casing;

3. a magnet secured in said tube at said one end portion of the tube;

4. a conducting ball normally held in said one end portion of the tube by said magnet;

5. an insulating sleeve in the other end portion of said tube; and 6. a conducting body in said other end portion held in said insulated sleeve so as to be electrically isolated from said tube, said conducting body being connected to said electrical means and having an inclined surface facing said one end of said tube such that said body and lower interior wall of the tube define a V-shaped entrance into which said ball seats to effect electrical contact between the body and tube whereby when said deliberate, rapid acceleration and/or deceleration of the wrist is effected, said ball is shaken free of said magnet to travel to said other end of said tube and make at least one momentary contact with said conducting body so that a circuit is completed from said one terminal through said casing, tube, ball and said conducting body to said electrical means.

2. The combination of claim 1, in which said conducting body incorporates a second magnet embedded therein with an exposed face on said inclined surface of less strength than said first mentioned magnet such that said ball will be held by said second magnet to maintain said circuit until the wrist is accelerated and/or decelerated deliberately sufficiently to shake the ball loose from said second magnet and have it captured and held by the first magnet.

* * * * *